United States Patent [19]

Mailliet et al.

[11] Patent Number: 4,588,168

[45] Date of Patent: May 13, 1986

[54] DEVICE FOR REGULATING THE DELIVERY OF HOT AIR IN A TUYERE STOCK OF A SHAFT FURNACE AND A TUYERE STOCK WHICH INCORPORATES THE SAME

[75] Inventors: Pierre Mailliet, Howald; Gilbert Bernard, Helmdange; Marc Calmes, Luxembourg, all of Luxembourg

[73] Assignee: Paul Wurth S.A., Luxembourg

[21] Appl. No.: 669,257

[22] Filed: Nov. 7, 1984

[30] Foreign Application Priority Data

Nov. 7, 1983 [LU] Luxembourg ..... 85079

[51] Int. Cl.[4] ..... C21B 7/16

[52] U.S. Cl. ..... 266/81; 251/305; 266/187; 266/223; 266/266; 432/40

[58] Field of Search ..... 266/265-270, 266/187, 44, 223, 81; 251/305; 432/40

[56] References Cited

U.S. PATENT DOCUMENTS

| | | | |
|---|---|---|---|
| 2,406,075 | 8/1946 | Grares, Jr. et al. | 266/187 |
| 3,298,824 | 1/1967 | Grace et al. | 75/41 |
| 3,640,499 | 2/1972 | Jung | 251/305 |

FOREIGN PATENT DOCUMENTS

| | | | |
|---|---|---|---|
| 70142 | 8/1893 | Fed. Rep. of Germany | 266/187 |
| 986807 | 3/1965 | United Kingdom | 266/187 |

*Primary Examiner*—Melvyn J. Andrews
*Attorney, Agent, or Firm*—Fishman & Dionne

[57] ABSTRACT

An apparatus for regulating the feed or delivery of hot air in the tuyere stock of a shaft furnace, and a tuyere stock which incorporates such a regulating apparatus is presented. The regulating apparatus may be used in conjunction with a tuyere stock for a shaft furnace (the structure of which is well known) and consists of an articulated pipe connecting a large circular conduit to a nozzle and which is fitted internally with a refractory lining having an internal channel therethrough for the passage of air. The regulating apparatus of the present invention comprises a valve substantially in the form of a disc which is adapted to operate in a spherical portion of the internal channel described above. The disc is removably mounted on the end of a rod, the rod being rotatably and hermetically mounted in a tubular support integral with the wall of the tuyere stock and connected on the outside thereof to a mechanism which serves to pivot both the rod and the valve about the longitudinal axis 0 of the rod.

45 Claims, 7 Drawing Figures

DEVICE FOR REGULATING THE DELIVERY OF HOT AIR IN A TUYERE STOCK OF A SHAFT FURNACE AND A TUYERE STOCK WHICH INCORPORATES THE SAME

BACKGROUND OF THE INVENTION

This invention relates generally to an apparatus for regulating the delivery of hot air in the tuyere stock of a shaft furnace; the tuyere stock consisting of an articulated pipe connecting a circular or annular supply conduit to a nozzle and being provided with an internal refractory lining. This invention also relates to a tuyere stock having the air feed regulating apparatus incorporated therein.

It is well know that the combustion and reduction processes in a shaft furnace, particularly in a blast furnace, are maintained by means of hot air and solid or liquid fuel which are injected through a series of tuyeres in the furnace structure, i.e., hearth of the furnace. However, the hot air is not distributed uniformly among the different tuyeres, due to a lack of symmetry in the fusion zone of the furnace. This asymmetrical fusion zone is caused by uncontrolled descent of material (non-uniform material distribution) into the furnace which creates different pressure losses opposite the respective tuyeres thus leading to a variation in the feed rate of hot air from one tuyere to another. As a result, the feed rate of hot air from one tuyere to another may thus differ by between 20 and 100%. Consequently, as the combustible materials (fuels) are burnt with the oxygen from the hot air, their injection rates have to be regulated in accordance with particular feed rates through each particular tuyere.

Measuring the delivery or feed rate in each of the tuyere stocks permits the determination of those places wherein the admission of hot air is more intensive (high feed rate) or less intensive (low feed rate). By reducing the unnecessarily high rates of feed, therefore, excess hot air from more intensive tuyeres may be guided towards those tuyeres with a low rate of feed. In other words, if the hot air feed rate can be regulated or modified, than the less active tuyere locations may be stimulated such that the furnace may operate more uniformly regardless of the non-uniform material distribution of the furnace (i.e., asymmetrical fusion zone). The resulting furnace would thus function more efficiently and under more satisfactory conditions.

Unfortunately, the prior art has no effective or practical means of regulating the feed rate of hot air from a tuyere stock into a tuyere. It is a object of the present invention to address this deficiency in the prior art as will be discussed in more detail hereinafter.

SUMMARY OF THE INVENTION

The above discussed and other problems of the prior art are overcome or elevated by the hot air regulating device of the present invention. In accordance with the present invention, an apparatus for regulating the feed or delivery of hot air in the tuyere stock of a shaft furnace, and a tuyere stock which incorporates such a regulating apparatus is provided.

The regulating apparatus of the present invention may be used in conjunction with a tuyere stock for a shaft furnace (the structure of which is well known) and consists of an articulated pipe connecting a large circular conduit to a nozzle and which is fitted internally with a refractory lining having an internal channel therethrough for the passage of air. The regulating apparatus of the present invention comprises a valve substantially in the form of a disc which is adapted to operate in a spherical portion of the internal channel described above. The disc is removably mounted on the end of a rod, the rod being rotatably and hermetically mounted in a tubular support integral with the wall of the tuyere stock and connected on the outside thereof to a mechanism which serves to pivot both the rod and the valve about the longitudinal axis 0 of the rod.

The rod, in turn, comprises on the end associated with the valve, a cylindrical cheek having a concave face which receives a convex face of a cylindrical sleeve of the valve. The respective concave and convex surfaces of the rod and valve thus ensure contact between the adjacent faces of the cheek and sleeve. When the apparatus is assembled and in the operating position, a hammer shaped piece is provided which passes coaxially through the rod, the cheek of the rod and a portion of the circular sleeve. This portion of the circular sleeve includes a substantially cylindrical cavity which receives and accomodates the head of the hammer shaped piece.

The head of the hammer shaped structure is detachable from the sleeve of the valve by a rotary and translatory movement out of a frontal cavity of the cheek of the rod and then through a channel between the cavity in the sleeve of the valve and its convex face. The section of this channel and that of the frontal cavity of the cheek of the rod is approximately equal to that of the head of the hammer-shaped body.

The shaft of the hammer shaped piece is tightly secured on the rod by means of an interposed spring and via a locking system.

Preferably, the valve and the cheek of the rod should be constructed from a silicon carbide as this material is characterized by very high thermal resistance and also exceptional strength. It will be appreciated however, that any other suitable material having these physical properties may also be utilized in conjunction with the present invention.

Preferably, the tubular support is provided with a double wall which encloses a first cooling circuit. A second cooling circuit is preferably provided through a double wall of the rod and the handle of the hammer (the hammer handle being hollow to provide for this second cooling circuit).

In accordance with the present invention, a tuyere stock provided with the above discussed regulating apparatus may have the latter either intergrated in the wall of the tuyere stock or detachably mounted between two flanges of the articulated pipe.

The above discussed and other advantages of the present invention will be apparent to and understood by those skilled in the art from the following detailed description and drawings.

BRIEF DESCRIPTION OF THE DRAWINGS

Referring now to the drawings, wherein like elements are numbered alike in the several Figures.

DESCRIPTION OF THE PREFERRED EMBODIMENT

Figure 1:
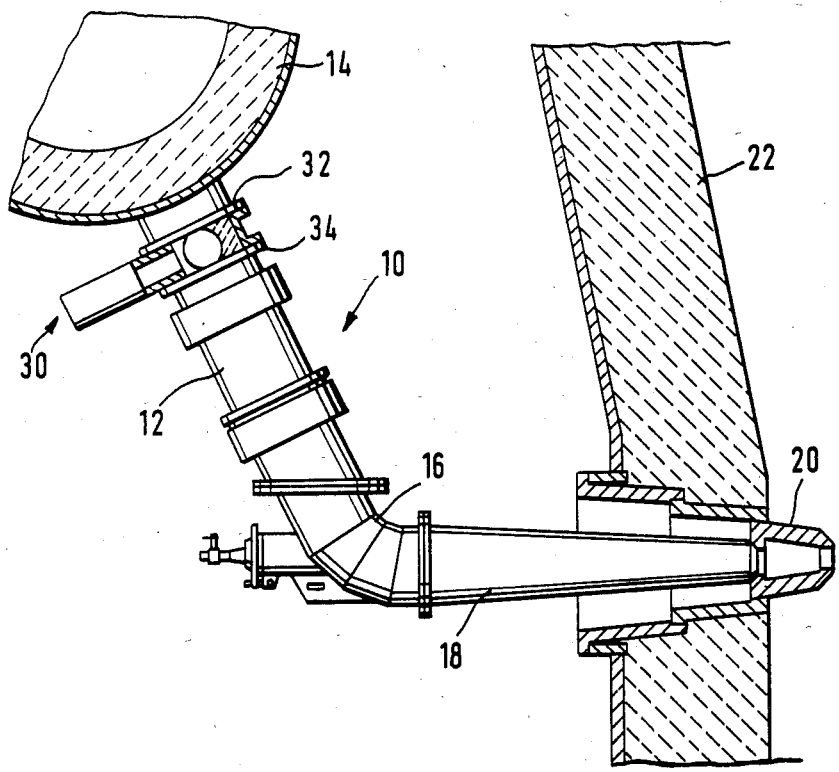
FIG. 1 is a elevation view, partly in cross-section, of a tuyere stock having a hot air feed regulating apparatus in accordance with the present invention.

Referring first to FIG. 1, a schematic diagram of a tuyere stock generally identified at 10 is shown comprised of a descending articulated pipe 12, which connects a large circular hot air conduit 14 to a bend portion 16. Bend portion 16 is attached to a nozzle 18, nozzle 18 being removably attached to a tuyere 20, which is secured in a wall 22 of a shaft furnace. Tuyere stock 10 of FIG. 1 also includes an apparatus 30 for regulating the feed of hot air through the tuyere stock and into tuyere 20. Regulating apparatus 30 is removably mounted in the upper portion of articulated pipe 12 by means of a bolting system between two opposite flanges 32 and 34 of the pipe 12.

Figure 2:
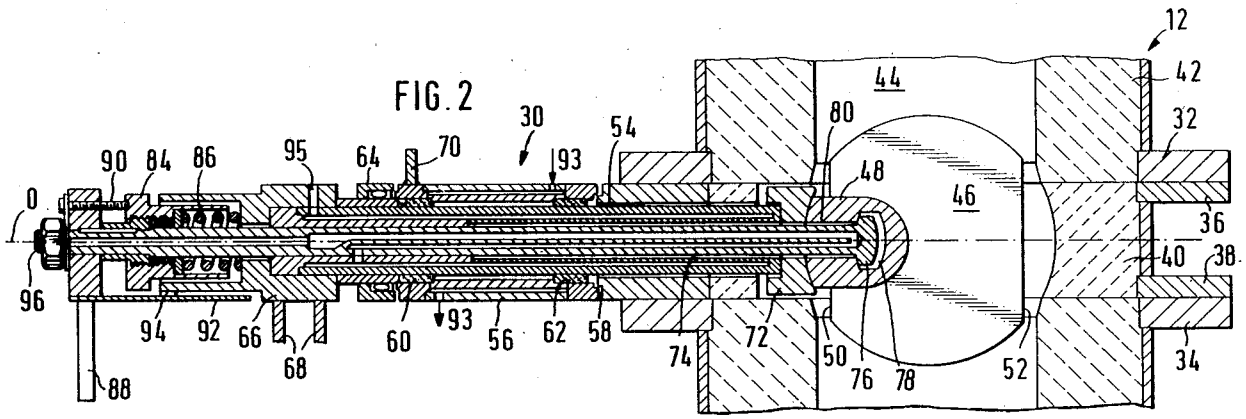
FIG. 2 is a cross-sectional elevation view of the regulating apparatus in accordance with the present invention.

Referring now to FIG. 2, the structural details of the hot air regulating apparatus of the present invention are shown. The regularing apparatus comprises two circular flanges 36 and 38 corresponding to flanges 32 and 34 and being tightly secured between the latter by a bolting system. Regulating apparatus 30 can thus be dismantled by an unbolting operation with the apparatus being removed laterally from pipe 12. Flanges 36 and 38 are provided around an annular core 40 of refractory material, this material corresponding to the refractory lining 42 of pipe 12, the refractory lining 42 surrounding a hot air channel 44.

The interior of refractory core 40 forms a relatively widened, sperical portion of the refractory lining 42 which enables the regulating valve of the present invention to be mounted and operated; this valve essentially taking the form of a pivotable disc 46 provided with a mounting sleeve 48. Note that the opposite edges 50, 52, of valve 46 are mutually parallel so as to enable valve 46 to be introduced into and extracted from channel 44 in an axial direction for assembly and replacement purposes, respectively.

Valve 46 is attached to the inner end of a rotary rod 54 which passes through refractory core 40 and flanges 36 and 38 and is finally supported in a cylindrical support 56. Support 56 is detachably mounted, at the point identified at 58 (and by means not shown in the drawing), to flanges 36 and 38. Rotary rod 54 is firmly secured in support 56 by means of self-lubricating nose pieces 60, 62, and a joint 64.

The outer or exterior end of rod 54 is secured in a block 66 and may be integrally attached thereto. Block 66 includes one or two arms 68 actuated by a jack or other motor (not shown). Arms 68 along with an arm 70 (integral with support 56) are provided to cause rod 54 to pivot about its longitudinal axis 0.

The inner or interior end of rod 54 comprises a substantially cylindrical cheek 72 whose inner face is in contact with the outer face of sleeve 48 of the valve 46. Preferably, the profiles (surfaces structures) of the adjacent faces of cheek 72 and sleeve 48 are complementary to each other. In the illustrated example, the face of cheek 72 is concave while sleeve 48 is correspondingly convex, of course, the converse may also be utilized.

Cheek 72 and valve 46 (along with securing sleeve 48) are preferably comprised of silicon carbide, which is characterized by excellent resistance to high temperatures as well as by good mechanical strength; and above all by far less fragility than other ceramic materials. It will be appreciated that any other material having suitable heat resistance and strength may also be used herein.

Valve 46 is removably attached to cheek 72 by a securing system of the "bayonet" type. For this purpose, a hammer-shaped piece is provided having a shaft 74 which passes coaxially through rod 54 and cheek 72. In an operating position, head 76 of the hammer-shaped piece is positioned in a substantially cylindrical cavity 78 inside sleeve 48. In the position shown in FIG. 2, head 76 of the hammer maintains valve 46 rigidly secured to cheek 72. Valve 46 is released by rotating the hammer through an angle of 90° and then performing a translatory movement in order to extract head 76 through a channel 80 (that section of the channel being sized to correspond to the size of the head 76), and into a frontal cavity (not shown) which is provided for this purpose in the concave face of the cheek 72. The hammer-shaped piece and rod 54 are held tightly together by means of a nut 84 tightened around the screw-threaded end of shaft 74 in opposition to the action of a spring 86 positioned around rod 74 and resting on block 66. Spring 86 acts to compensate for the differential thermal expansions between valve 46, cheek 72, rod 54, shaft 74 and head 76.

The relative rotation between shaft 74 and valve 46 for the purpose of releasing the latter from cheek 72 is effected by means of a lever 88 which is integral with the end of shaft 74. Lever 88 is preferably orientated in such a way as to indicate the orientation, i.e. position, of valve 46.

Nut 84 is locked by means of a screw 90 to prevent it from being accidentally loosened. For further security, a locking system of the "bayonet" type is provided which consists of a semi-cylindrical plate 92 of "U-shaped" associated with a lateral finger 94 provided on block 66.

To ensure the transmission of rotatory movement from rod 54 to valve 46, i.e. to avoid relative slip between the adjacent faces of the rod 54 and the cheek 72, as well as between check 72 and sleeve 48, the faces may be provided with a cam and a corresponding cavity respectively; alternatively their curvatures may be radially asymmetrical in relation to the axis 0.

Preferably, tubular support 56 is provided with a double wall which enables it to be connected to a water cooling circuit identified by reference number 93. Similarly, a second cooling circuit is provided through a double wall of rod 54 and through an axial cavity in the shaft 74 of the hammer-shaped piece. The water of this second cooling circuit enters through a lateral orifice 95 and exits in the axial direction at the rear end 96 of shaft 74.

In order to reduce possible contamination, small quantities of cold air may be injected in the opposite direction at the level of securing device 58. This quantity of air is preferably drawn from a mixing chamber, (not shown) wherein the hot air is given the necessary injection of cold air to stabilize its temperature at a pre-determined value.

Figure 3:
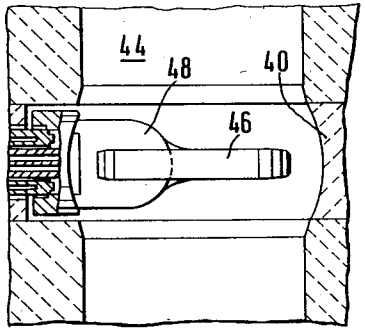
FIG. 3 is a cross-sectional elevation view of an enlarged section of the regulating apparatus of FIG. 2.

Turning now to FIG. 3, valve 46 is shown in a closed position. This position is obtained by rotation through an angle of 90° from the position shown in FIG. 1 under the action of a jack (not shown) and which as discussed above, acts on arms 68.

Figure 4:
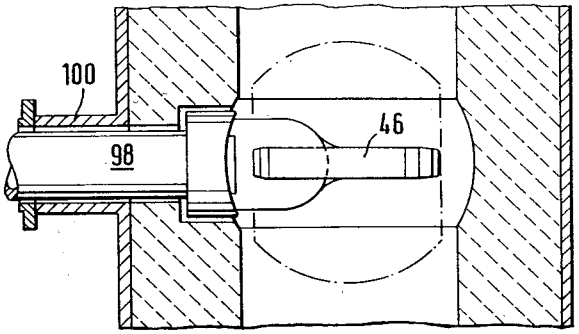
FIG. 4 is a cross-sectional elevation view of a variation of the structure of FIG. 3.

While the regulating device of the present invention shown in FIGS. 1 and 2 is an independent unit mounted between two flanges 32 and 34 of the tuyere stock 10, the regulating apparatus 98 of FIG. 4 has instead been integrated into the tuyere stock 10 via a pipe 100, pipe 100 being provided for this purpose in the metal housing of the tuyere stock or in the connecting pipe of the circular conduit. The apparatus shown in FIG. 4 is of relatively simpler construction then that shown in FIGS. 1 and 2 and is specifically designed to be used in conjunction with existing tuyere stocks. This is in contrast with the FIG. 2 device which is independent and can be installed only if the available space is sufficient. The construction of the regulating device shown in FIG. 4 is otherwise identical to that of the device illustrated in FIG. 2.

Figure 5:
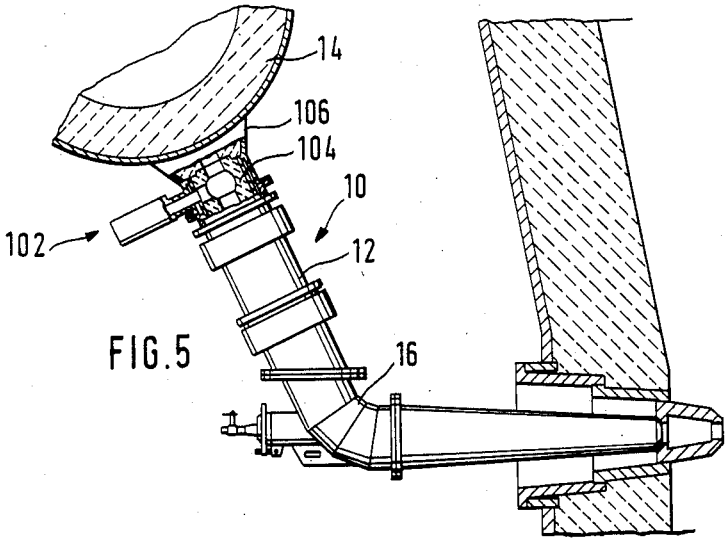
FIG. 5 is a elevation view, partly in cross-section, similar to FIG. 1 wherein the regulating apparatus is incorporated in a connecting pipe which is intergrated with the circular conduit.

FIG. 5 shows an intermediate construction between the embodiments of FIG. 2 and 4. In FIG. 5, the regulating device 102 of the present invention is incorporated in the wall 106 of a pipe integral with the circular conduit 14. However, the actual valve is located in a tip 104 independent of the pipe and is detachably mounted to a flange of the descending pipe 12.

Figure 6:
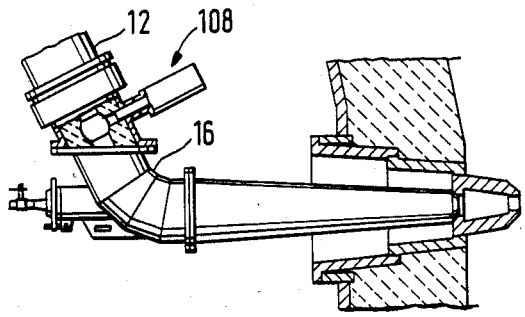
FIG. 6 is a elevation view, partly in cross-section of the regulating apparatus of the present invention incorporated in the lower portion of a tuyere stock.

In FIG. 6, a regulating device 108 in accordance with the present invention is shown incorporated into the lower portion of descending pipe 12. Regulating device 108 is oriented in FIG. 6 towards the furnace but can be oriented in other directions if required so as to occupy the smallest possible amount of space and avoid impeding access for maintenance purposes.

Figure 7:
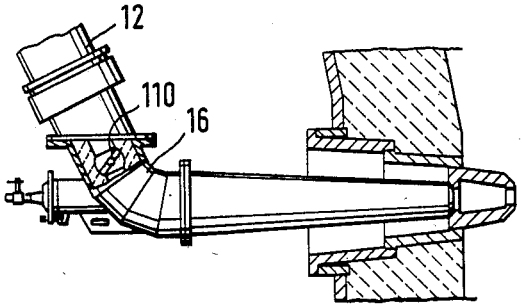
FIG. 7 is a elevation view, partly in cross-section of the regulating apparatus of the present invention incorporated in the bend of a tuyere stock.

A regulating device for the feed of hot air in accordance with the present invention may also be provided in bend 16. Referring to FIG. 7, a valve 110 in accordance with the present invention is positioned in the right-hand portion of bend 16, immediately downstream of descending pipe 12.

It will be appreciated that the embodiments of FIGS. 6 and 7 have the advantage of being positioned downstream of those tuyere stock sections wherein the feed measuring operations are effected, these sections being generally located in the central portion of articulated pipe 12.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An apparatus for regulating the delivery of air in a tuyere stock of a shaft furnace, the tuyere stock including an articulated pipe section connected at a first end to an annular conduit and at a second end to a nozzle, at least a portion of the tuyere stock being lined with a refractory material having an internal channel therethrough for the passage of air, the regulating appartus comprising:

valve means;

rod means having a longitudinal axis, said valve means being mounted on a first end of said rod means, said valve means and said first end of said rod means adapted for being disposed internally of said tuyere stock;

cylindrical support means, said cylindrical support means being adapted to attach to a portion of said tuyere stock, said rod means being rotatatably and hermetically mounted in said cylindrical support means;

means external of said tuyere stock for pivoting said rod means and said valve means about said longitudinal axis wherein said delivery of hot air is varied in said tuyere stock between an open and closed position;

wherein said first end of said rod means includes;

a cylindrical cheek; and wherein said valve means includes;

a cylindrical sleeve, said cylindrical cheek and cylindrical sleeve having complimentary adjacent surfaces; and means for selectively maintaining contact between said complimentary adjacent surfaces.

2. The apparatus of claim 1 wherein:

said valve means has a substantially disch shape; and wherein said internal channel defined by said refractory lining has a substantially spherical shape for receiving said disc shaped valve means.

3. The apparatus of claim 1 wherein:

said valve means is removably mounted on a first end of said rod means.

4. The apparatus of claim 1 wherein:

one of said complimentary surfaces in convex and the other of said complimentary surfaces is concave.

5. The apparatus of claim 1 wherein said means for maintaining selective contact comprises:

an elongated member having a shaft portion and a head portion;

said shaft portion passing coaxially through said rod means, said cylindrical cheek and a portion of said cylindrical sleeve;

said cylindrical sleeve including a cavity for receiving said head portion.

6. The apparatus of claim 5 wherein:

said head portion is substantially hammer-shaped.

7. The apparatus of claim 5 wherein:

said cavity is substantially cylindrical.

8. The apparatus of claim 5 including:

a channel means between said cavity of said cylindrical sleeve and said sleeve surface; and wherein said head portion is detachable from said cylindrical sleeve cavity of said valve means through said channel means.

9. The apparatus of claim 8 wherein:

said channel means and said cavity are sized to receive said head portion.

10. The apparatus of claim 1 wherein:

said rod means, cheek and sleeve are provided with means for secure interconnection.

11. The apparatus of claim 10 wherein:

said shaft portion has a threaded end opposite opposite the head portion; and a wherein said interconnection means comprises;

a nut adapted to be received by said threaded end;

block means attached to a second end of said rod means;

spring means positioned about said shaft portion, said spring means exerting a force in opposition to said threadable nut.

12. The apparatus of claim 5 including:

lever means for rotating said elongated number through an angle of 90°, said lever means being attached to said second end of said shaft portion.

13. The apparatus of claim 12 including:

means for locking said lever means into a selected position.

14. The apparatus of claim 1 wherein:

said cylindrical sleeve and cheek are substantially comprised of silicon carbide.

15. A tuyere stock adapted for connection to a circular conduit comprising:

an articulated pipe section having a first end and a second end;

said first end being adapted to connected to said circular conduit;

a nozzle connected to said second end of said articulated pipe;

at least a portion of said articulated pipe, circular conduit and nozzle being lined with a refractory material having an internal channel therethrough for the passage of air; and means for regulating the delivery of air in said tuyere stock comprising;

valve means;

rod means having a longitudinal axis, said valve means being removably mounted on a first end of said rod means, said valve means and said first end of said rod means being disposed internally of said tuyere stock;

cylindrical support means, said cylindrical support means being attached to a portion of said tuyere stock, said rod means being rotatably and hermetically mounted in said cylindrical support means;

means external of said tuyere stock for pivoting said rod means and said valve means about said longitudinal axis wherein said delivery of hot air is varied in said tuyere stock between an open and closed position;

wherein said first end of said rod means includes;

a cylindrical cheek; and wherein said valve means includes;

a cylindrical sleeve, said cylindrical cheek and cylindrical sleeve having complimentary adjacent surfaces; and means for selectively maintaining contact between said complimentary adajcent surfaces.

16. The tuyere stock of claim 15 wherein:

said valve means has s substantially disc shape; and wherein:

said internal channel defined by said refractory lining has a substantially spherical shape for receiving said disc shaped valve means.

17. The tuyere stock of claim 15 wherein:

said valve means is removably mounted on a first end of said rod means.

18. The tuyere stock of claim 15 wherein:

one of said complimentary surfaces in convex and the other of said complimentary surfaces is concave.

19. The tuyere stock of claim 15 wherein said means for maintaining selective contact comprises:

an elongated member having a shaft portion and a head portion;

said shaft portion passing coaxially through said rod means, said cylindrical cheek and a portion of said cylindrical sleeve;

said cylindrical sleeve including a cavity for receiving said head portion.

20. The tuyere stock of claim 19 wherein:

said head portion is substantially hammer-shaped.

21. The tuyere stock of claim 19 wherein:

said cavity is substantially cylindrical.

22. The tuyere stock of claim 19 including:

a channel means between said cavity of said cylindrical sleeve and said sleeve surface; and wherein said head portion is detachable from said cylindrical sleeve cavity of said valve means through said channel means.

23. The tuyere stock of claim 22 wherein:

said channel means and said cavity are sized to receive said head portion.

24. The tuyere stock of claim 15 wherein:

said rod means, check and sleeve are provided with means for secure interconnection.

25. The tuyere stock of claim 24 wherein:

said shaft portion has a threaded end opposite opposite the head portion; and a wherein said interconnection means comprises;

a nut adapted to be received by said threaded end;

block means attached to a second end of said rod means;

spring means positioned about said shaft portion, said spring means exerting a force in opposition to said threadable nut.

26. The tuyere stock of claim 19 including:

lever means for rotating said elongated number through an angle of 90°, said lever means being attached to said second end of said shaft portion.

27. The tuyere stock of claim 26 including:

means for locking said lever means into a selected position.

28. The tuyere stock of claim 15 wherein:

said cylindrical sleeve and cheek are substantially comprised of silicon carbide.

29. The tuyere stock of claim 19 wherein:

said rod means and elongated member have a double wall adapted to receive a second cooling circuit.

30. The tuyere stock of claim 15 wherein said tuyere stock further includes:

a pair of oppositely disposed flanges; and wherein said regulating means is removably mounted between said two flanges.

31. The tuyere stock of claim 15 wherein:

said regulating means is incorporated through said articulated pipe section.

32. The tuyere stock of claim 15 wherein said articulated pipe includes a straight section and an adjacent bend section; and wherein said regulating means is positioned in said straight section in the area adjacent said bend section.

33. The tuyere stock of claims 31 and 32 wherein said articulated pipe includes a straight section and an adjacent bend section; and wherein said regulating means is positioned in said bend section.

34. The tuyere stock of claims 30 and 31 wherein including:

an extension pipe between said articulated pipe first end and said annular conduit; and wherein said regulating means is positioned in said extention pipe.

35. The tuyere stock of claim 15 wherein:

said valve means is positioned in an independent tip of said articulated pipe and the other elements of said regulating means ares incorporated through the wall of said articulated pipe section.

36. An apparatus for regulating the delivery of air in a tuyere stock of a shaft furnace, the tuyere stock including an articulated pipe section connected at a first end to an annular conduit and at a second end to a nozzle, at least a portion of the tuyere stock being lined with a refractory material having an internal channel therethrough for the passage of air, the regulating apparatus comprising:

valve means;

rod means having a longitudinal axis, said valve means being mounted on a first end of said rod means, said valve means and said first end of said rod means adapted for being disposed internally of said tuyere stock;

cylindrical support means, said cylindrical support means being adapted to attach to a portion of said tuyere stock, said rod means being rotatably and hermetically mounted in said cylindrical support means;

means external of said tuyere stock for pivoting said rod means and said valve means about said longitudinal axis wherein said delivery of hot air is varied in said tuyere stock between an open and closed position; and wherein said cylindrical support means has a double wall adapted to receive a second cooling circuit.

37. The apparatus of claim 36 wherein:

said valve means has a substantially disc shape; and wherein said internal channel defined by said refractory lining has a substantially spherical shape for receiving said disc shaped valve means.

38. The apparatus of claim 36 wherein:

said valve means is removably mounted on a first end of said rod means.

39. The apparatus of claim 36 wherein:

said rod means and elongated member have a double wall adapted to receive a second cooling circuit.

40. An apparatus for regulating the delivery of air in a tuyere stock of a shaft furnace, the tuyere stock including an articulated pipe section connected at a first end to an annular conduit and at a second end to a nozzle, at least a portion of the tuyere stock being lined with a refractory material having an internal channel therethrough for the passage of air, the regulating apparatus comprising:

valve means;

rod means having a longitudinal axis, said valve means being mounted on a first end of said rod means, said valve means and said first end of said rod means adapted for being disposed internally of said tuyere stock;

cylindrical support means, said cylindrical support means being adapted to attach to a portion of said tuyere stock, said rod means being rotatably and hermetically mounted in said cylindrical support means;

means external of said tuyere stock for pivoting said rod means and said valve means about said longitudinal axis wherein said delivery of hot air is varied in said tuyere stock between an open and closed position; and wherein said rod means has a double wall adapted to receive a second cooling circuit.

41. The apparatus of claim 40 wherein:

said valve means has a substantially disc shape; and wherein said internal channel defined by said refractory lining has a substantially spherical shape for receiving said disc shaped valve means.

42. A tuyere stock adapted for connection to a circular conduit comprising:

an articulated pipe section having a first end and a second end;

said first end being adapted to connect to said circular conduit;

a nozzle connected to said second end of said articulated pipe;

at least a portion of said articulated pipe, circular conduit and nozzle being lined with a refractory material having an internal channel therethrough for the passage of air; and means for regulating the delivery of air in said tuyere stock comprising:

valve means;

rod means having a longitudinal axis, said valve means being removably mounted on a first end of said rod means, said valve means and said first end of said rod means being disposed internally of said tuyere stock;

cylindrical support means, said cylindrical support means being attached to a portion of said tuyere stock, said rod means being rotatably and hermetically mounted in said cylindrical support means;

means external of said tuyere stock for pivoting said rod means and said valve means about said longitudinal axis wherein said delivery of hot air is varied in said tuyere stock between an open and closed position; and wherein said cylindrical support means has a double wall adapted to receive a first cooling circuit therethrough.

43. The tuyere stock of claim 42 wherein:

said valve means has a substantially disc shape; and wherein:

said internal channel defined by said refractory lining has a substantially spherical shape for receiving said disc shaped valve means.

44. The apparatus of claim 42 wherein:

said valve means is removably mounted on a first end of said rod means.

45. A tuyere stock adapted for connection to a circular conduit comprising:

an articulated pipe section having a first end and a second end;

said first end being adapted to connect to said circular conduit;

a nozzle connected to said second end of said articulated pipe;

at least a portion of said articulated pipe, circular conduit and nozzle being lined with a refractory material having an internal channel therethrough for the passage of air; and means for regulating the delivery of air in said tuyere stock comprising:

valve means;

rod means having a longitudinal axis, said valve means being removably mounted on a first end of said rod means, said valve means and said first end of said rod means being disposed internally of said tuyere stock;

cylindrical support means, said cylindrical support means being attached to a portion of said tuyere stock, said rod means being rotatably and hermetically mounted in said cylindrical support means;

means external of said tuyere stock for pivoting said rod means and said valve means about said longitudinal axis wherein said delivery of hot air is varied in said tuyere stock between an open and closed position; and wherein said rod means has a double wall adapted to receive a second cooling circuit.

* * * * *